United States Patent [19]

Agresta

[11] Patent Number: 5,020,569

[45] Date of Patent: Jun. 4, 1991

[54] VENTED FAUCET SYSTEM

[75] Inventor: Frank J. Agresta, Wallingford, Conn.

[73] Assignee: WPM, Inc., Waterbury, Conn.

[21] Appl. No.: 591,382

[22] Filed: Oct. 1, 1990

[51] Int. Cl.[5] ..... E03C 1/02

[52] U.S. Cl. ..... 137/544; 137/801; 210/418

[58] Field of Search ..... 137/544, 801; 210/418

[56] References Cited

U.S. PATENT DOCUMENTS

| | | | |
|---|---|---|---|
| 3,719,593 | 3/1973 | Astil . | |
| 4,210,533 | 7/1980 | Astl | 210/418 X |
| 4,635,673 | 1/1987 | Gerdes | 137/216 |
| 4,967,784 | 11/1990 | Barhydt et al. | 137/801 X |

*Primary Examiner*—Gerald A. Michalsky
*Attorney, Agent, or Firm*—Dallett Hoopes

[57] ABSTRACT

A valve housing encloses an upward valve seat connected to the water inlet. A valve chamber above the seat receives a valve element and has a lateral bypass chamber connected to a fitting which leads to the filter. A tubular valve stem/outlet spout above the valve element is spring-pressed downward, normally holding the valve element down on the seat and may be raised by a handle allowing the valve element to raise to permit water to flow through the bypass to the filter. Filter discharge water is connected to a bypass return fitting on the valve housing which conducts water to a chamber surrounding lower part of the stem and into the stem through a radial opening and up and out the spout.

6 Claims, 1 Drawing Sheet

VENTED FAUCET SYSTEM

BACKGROUND OF THE INVENTION

1. Field of the Invention

This invention relates to accessory faucets, or so-called "third faucets", which are installed on the sink top adjacent to the conventional hot and cold water faucets. A third faucet is used to provide purified water for drinking when the usual household water is not suitable or desirable for drinking purposes. More specifically, the invention relates to a third faucet which is "vented"; that is, the outlet from the faucet valve is conducted back away from the faucet to the purifier or filter and from the purifier back to the faucet and out the faucet spout. Thus the invention relates to a "vented" faucet system.

2. Description of Related Art including Information Disclosed under §§1.97 to 1.99

In the usual type of purified water system used with third faucets the filter is usually installed in the line between the water source and the third faucet. This means that the structure of the filter is subjected to household water pressure which may reach up into the neighborhood of 100 psi or more. Because of this the filter chamber and the fittings thereto must be designed to withstand such pressure without rupture or leakage. This requires heavy duty design with substantial fittings and wall thicknesses and has added to the cost of the filter. At the same time, because the filter is subjected to household pressure at all times, the cleaning or replacement of the filter has required shutting down the water supply to the filter, an inconvenience, unnecessary and undesirable.

In the prior art there are showings somewhat comparable to the present system. See, for instance, U.S. Pat. No. 4,210,533 to Astl issued Jul. 1, 1980. Also, my assignee's own U.S. Pat. No. 4,345,719 issued Aug. 24, 1982 and U.S. Pat. No. 4,537,360 issued Aug. 27, 1985 to Bock and my pending application Ser. No. 07/525,069 filed May 18, 1990 (my file WPM-2-D).

SUMMARY OF THE INVENTION

The system of the present invention places the filter on the downstream side of the faucet valve so that the filter is not under the usual household pressure. Pressure is applied to it only during the "on" condition of the faucet valve and that pressure is always vented through the spout of the third faucet. As a consequence, the filter may be of relatively light structure, of less substantial fittings and wall thickness. The filter, subject only to the back pressure arising from the resistance of the downstream passage, that is, the tubing to the valve housing and the passages therethrough to the outlet spout. Such back pressure should rarely add up to more than 10 or 15 psi.

In addition, of course, because the filter is not always subjected to household pressure, it does not need to be designed for continual changing stress instant to the presence of a varying high pressure head.

Moreover, because the filter is on the downstream side of the faucet valve, the filter may be readily cleaned and/or replaced without having to turn off a valve other than the regular faucet valve.

Finally, the specific valve design makes possible a valve seat of large passthrough giving ample flow rates at all times.

The invention may be summarized as a system in which a valve housing encloses an upward seat and is connected to an inlet fitting. The valve chamber above the seat contains a valve element and has a lateral bypass which is connected to a fitting running to the filter. Coming back from the filter a bypass return is connected to a passage within the housing which goes up into a valve stem chamber. The valve element is urged downward to seat by a valve stem/outlet spout disposed in the valve stem chamber and circumposed by an axial compression spring. The stem has lateral ports which permit the return liquid to exit through the stem and out an attached spout.

BRIEF DESCRIPTION OF THE DRAWINGS

Other features and objects of the invention will be apparent from the following specification and the drawings, all of which disclose a non-limiting embodiment of the invention. In the drawings.

DESCRIPTION OF THE PREFERRED EMBODIMENT

Figure 1:
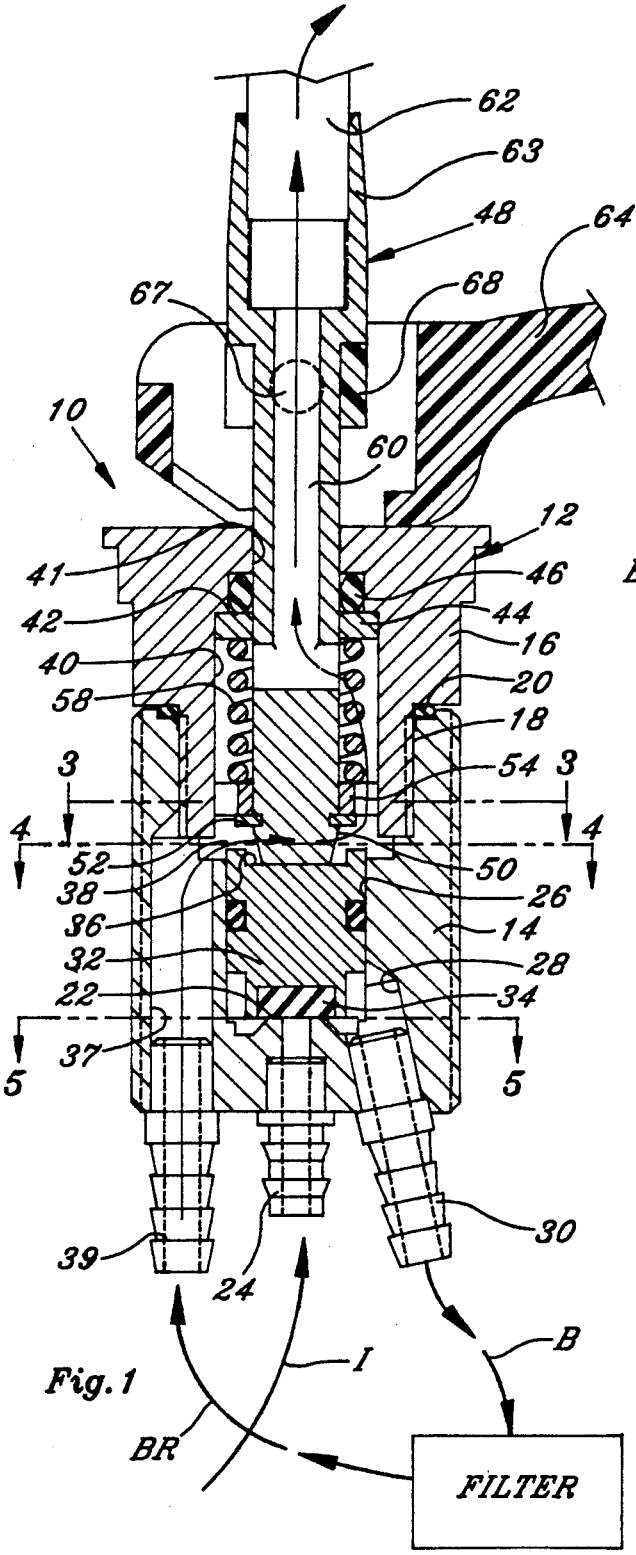
FIG. 1 is a center line sectional view of a system and valve housing embodying the invention.

A system including a faucet valve housing is shown in FIG. 1 and generally designated 10. The connecting lines and filter are shown diagrammatically.

The valve comprises a housing 12 including a lower portion 14 and an upper portion 16. The lower portion 14 has a central well 18 which is threaded to receive the threaded reduced lower end of the upper portion 16 and these two portions are screwed together and sealed by an 0-ring 20 as shown.

The lower portion 14 has an upwardly facing valve seat 22 which is connected by a central passage as shown to an inlet fitting 24 in the bottom of the housing. Above the valve seat the lower portion is formed with a cylindrical valve chamber 26 and a lateral bypass chamber 28. The latter is connected to a bypass fitting 30 in the bottom of the housing.

Sealingly disposed in the valve chamber 26 is a valve element 32 which is provided on its lower end with a reduced section having an upward recess in which is secured a gasket 34 which cooperates with the valve seat 22 to seal off the inlet line from fitting 24. The upper end of the valve element has a central shallow depression 36.

A bypass return 37 extends up from the bottom of the housing at the side of the valve chamber 26 and into a lateral inlet passage 38. At its lower end the bypass return passage 37 is connected to a bypass return fitting 39 in the bottom of the housing.

Above the valve chamber 26 the housing 12 is provided with a valve stem chamber 40 which is a cylindrical upward recess in the upper portion 16 of the housing. The lateral inlet passage 38 communicates with the valve stem chamber 40.

The top of the housing has a central opening 41 which is reduced with respect to the valve stem chamber 40 so as to provide a neck having a downwardly facing shoulder 42 on which seats an annular boss 44. An O-ring 46 is disposed thereabove.

A single-piece valve stem 48 is provided and extends down through the opening 40, engages the O-ring seal 46 and passes through an upper annular collar 44. The lower end of the stem is tapered as at 50 and normally sits in the depression 36 on the valve element 32. Upward from its lower end the stem is formed with a peripheral groove which receives a snap washer 52. The snap washer supports a lower annular collar 54 also surrounding the stem 48. Collar 54 has vertical scallops 56 on its outer periphery.

Figure 3:
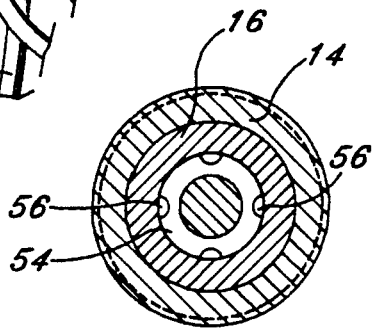
FIG. 3 is an sectional view taken on the line 3—3 of FIG. 1.
Figure 4:
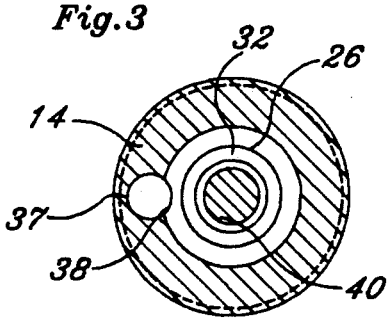
FIG. 4 is a sectional view taken on the line 4—4 of FIG. 1.
Figure 5:
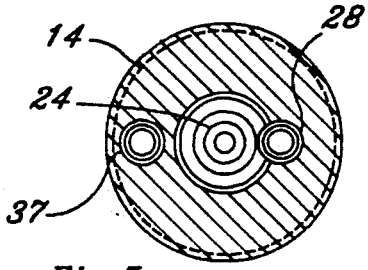
FIG. 5 is a sectional view taken on the line 5—5 of FIG. 1.

As shown in FIG. 3, the outward face of the collar 54 slidably engages the wall of the valve stem chamber to center the lower portion of the valve stem 48. Disposed in compression between the upper annular collar 44 and the lower annular collar 54 is an axial spring 58. The spring urges the stem downward so that the lower end of the stem abuts the top of the valve element 32 to hold the valve element down sealingly against the seat 22.

Spaced above its lower end the stem 48 is tubular having an internal bore 60 with radial ports as shown. At its upper end the stem 48 is enlarged as at 63 and has an upward mouth into which is threaded the valve spout 62. An operating handle 64 is pivotally connected as at 67 to a yoke 68 which surrounds the stem just under the enlargement 63.

Pressing down on the outward end of the handle 64 will cause the hub of the handle which bears on the top of the housing cams upward the pivot 67 and the stem as described in earlier patents, for instance U.S. Pat. No. 4,635,673 to Gerdes assigned to my assignee.

Figure 2:
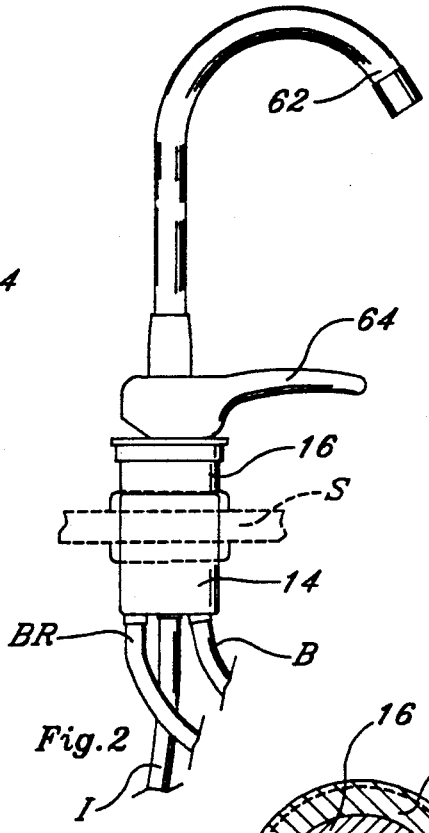
FIG. 2 is a reduced elevational view of a third faucet embodying the invention.

The system as shown includes an inlet line I connected to the inlet fitting 24, a bypass line B connected to the bypass fitting 30 and extending to the filter as shown in FIG. 1 and a bypass return BR connected to the fitting 38. The faucet may be mounted on a sink top S as shown in phantom in FIG. 2.

Thus, when the end of handle 64 is depressed, inlet water at household pressure will flow through to the seat 22, to the bypass chamber and out the fitting 30. From fitting 30 household water will pass through the bypass line B to the filter as shown. From the filter the purified water will pass through the bypass return BR to the fitting 39 through the bypass return passage 37 through the lateral inlet passage 38, into the valve stem chamber 40, through the scallops 56 of collar 54, through the central bore 60 of the stem and out the top of the spout 62.

Thus it will be seen that the filter is never subjected to household water pressure and that the other advantages set forth above are present in the described system. Especially noteworthy in the structure described is that the valve element 32 is substantially larger than the diameter of the valve stem 48 so that the seat opening in the seat 22 may be made ample, if desired, to permit good flow through the stem and out the spout 62.

Obviously there are reasonable variations and modification which may be made in the system of the invention and hence the invention is not limited to the embodiment shown. The invention, therefore, may be defined by the following claim language.

What is claimed is:

1. A vented faucet system comprising:

(a) a valve housing having a top and a bottom and enclosing an upwardly facing valve seat, an inlet fitting extending out the bottom of the housing and connected to the seat, a bypass chamber in the housing extending laterally from above the seat and communicating therewith, a bypass fitting extending out the bottom of the housing and connected to the bypass chamber, a valve chamber above the seat and having a cylindrical wall coaxial with the seat, a valve stem chamber above the valve chamber and coaxial therewith, the top of the housing extending inward to form a neck in the valve stem chamber, annular downward shoulder means under the neck, a lateral inlet passage communicating with the valve stem chamber, and a bypass return fitting extending out the bottom of the housing and connected to the lateral inlet passage, (b) a valve element reciprocably disposed in the valve chamber and sealingly engaging the cylindrical wall thereof and adapted to seat on the valve seat, (c) a valve stem disposed in the valve stem chamber and extending up through the neck, annular upward shoulder means outward from the stem spaced upward from lower end thereof, the stem having a radial inlet disposed between the upward shoulder means and the downward shoulder means and an axial passage in the stem connected to the radial inlet and extending upward to a system outlet, (d) spring means surrounding the valve stem and disposed in compression between the upward shoulder means and the downward shoulder means and urging the stem downward, the lower end of the stem engaging the valve element to hold it normally on the valve seat, (e) activating means engaging the stem above the housing to raise the stem to permit the valve element to unseat, pressed upward by water pressure in the seat, (f) a filter housing enclosing a filter element and having an intake and a discharge, (g) tubular line means connecting the bypass fitting and the filter housing intake and connecting the filter housing discharge and the bypass return fitting.

2. A vented faucet system as claimed in claim 1 wherein the lower end of the stem is tapered.

3. A vented faucet system as claimed in claim 2 wherein the valve element has an upwardly facing central depression and the lower end of the stem fits thereinto.

4. A vented faucet system as claimed in claim 1 wherein an O-ring seal surrounds the stem and engages the housing under the neck.

5. A vented faucet system comprising:

(a) a valve housing having a top and a bottom and enclosing an upwardly facing valve seat, an inlet fitting extending out the bottom of the housing and connected to the seat, a bypass chamber in the housing extending laterally from above the seat and communicating therewith, a bypass fitting extending out the bottom of the housing and connected to the bypass chamber, a valve chamber above the seat and having a cylindrical wall coaxial with the seat, a valve stem chamber above the valve chamber and coaxial therewith, the top of the housing extending inward to form a neck at the upper end of the valve stem chamber, annular downward shoulder means under the neck, a lateral inlet passage communicating with the valve stem chamber, and a bypass return fitting extending out the bottom of the housing and connected to the lateral inlet passage, (b) a valve element reciprocably disposed in the valve chamber and sealingly engaging the cylindrical wall thereof and adapted to seat on the valve seat, (c) a valve stem disposed in the valve stem chamber and extending up through the neck, annular upward shoulder means outward from the stem spaced upward from lower end thereof, the stem having a lateral inlet disposed between the upward shoulder means and the downward shoulder means and an axial passage in the stem connected to the lateral inlet and extending upward to a system outlet, (d) spring means surrounding the valve stem and disposed in compression between the upward shoulder means and the downward shoulder means and urging the stem downward, the lower end of the stem engaging the valve element to hold it normally on the valve seat, (e) a handle means engaging the stem above the housing to raise the stem to permit the valve element to unseat, pressed upward by water pressure in the seat, (f) a water purifying housing remote from the valve housing enclosing a water purifying means and having an intake and a discharge, (g) tubular line means connecting the bypass fitting and the filter housing intake and connecting the water purifying housing discharge and the bypass return fitting.

6. A vented faucet system comprising:

(a) a valve housing having a top and a bottom and enclosing an upwardly facing valve seat, an inlet fitting extending out the bottom of the housing and connected to the seat, a bypass chamber in the housing extending laterally from above the seat and communicating therewith, a bypass fitting extending out the bottom of the housing and connected to the bypass chamber, a valve chamber above the seat and having a cylindrical wall coaxial with the seat, a valve stem chamber above the valve chamber and coaxial therewith, the top of the housing extending inward to form a neck at the upper end of the valve stem chamber, annular downward shoulder means under the neck, a lateral inlet passage communicating with the valve stem chamber, and a bypass return fitting extending out the bottom of the housing and connected to the lateral inlet passage, (b) a valve element reciprocably disposed in the valve chamber and sealingly engaging the cylindrical wall thereof and adapted to seat on the valve seat, (c) a valve stem associated with the valve element and disposed in the valve stem chamber and extending up through the neck, annular upward shoulder means outward from the stem spaced upward from lower end thereof, the stem having a lateral inlet disposed between the upward shoulder means and the downward shoulder means and an axial passage in the stem connected to the lateral inlet and extending upward to a system outlet, (d) spring means surrounding the valve stem and disposed in compression between the upward shoulder means and the downward shoulder means and urging the stem downward, to hold the valve element normally on the valve seat, (e) a handle means engaging the stem above the housing to raise the stem, (f) a water purifying housing remote from the valve housing enclosing a water purifying means and having an intake and a discharge, (g) tubular line means connecting the bypass fitting and the filter housing intake and connecting the water purifying housing discharge and the bypass return fitting.

* * * * *